US008029027B2

(12) United States Patent
Tien

(10) Patent No.: US 8,029,027 B2
(45) Date of Patent: Oct. 4, 2011

(54) LATCH DEVICE FOR PANIC DOOR LOCK WITH ANTI-PICKING FUNCTION

(75) Inventor: Hung-Jen Tien, Tainan (TW)

(73) Assignee: I-Tek Metal Mfg. Co., Ltd., Tainan (TW)

( * ) Notice: Subject to any disclaimer, the term of this patent is extended or adjusted under 35 U.S.C. 154(b) by 696 days.

(21) Appl. No.: 12/194,576

(22) Filed: Aug. 20, 2008

(65) Prior Publication Data

US 2010/0043505 A1 Feb. 25, 2010

(51) Int. Cl.
*E05B 65/10* (2006.01)

(52) U.S. Cl. ..... 292/92; 292/DIG. 65

(58) Field of Classification Search ..... 292/92, 292/93, DIG. 65, 196; 70/92
See application file for complete search history.

(56) References Cited

U.S. PATENT DOCUMENTS 3,854,763 A * 12/1974 Zawadzki et al. ..... 292/201
4,709,950 A * 12/1987 Zortman ..... 292/92
4,878,722 A * 11/1989 Nelson et al. ..... 385/16
5,464,259 A * 11/1995 Cohrs et al. ..... 292/92
5,605,362 A * 2/1997 Surko, Jr. ..... 292/92
6,205,825 B1 * 3/2001 Haeck et al. ..... 70/92
6,641,183 B2 * 11/2003 Brown ..... 292/92
7,070,210 B2 7/2006 Lin ..... 292/93

* cited by examiner

*Primary Examiner* — Gary Estremsky
(74) *Attorney, Agent, or Firm* — Alan Kamrath; Kamrath & Associates PA

(57) ABSTRACT

A latch device (30) for a door lock includes a latch (38) pivotable between an extended, locking position and a retracted, unlocking position upon operation of a linking rod (37). A liming block (36) is coupled with the linking rod (37) and movable between a locking position not allowing direct pivotal movement of the latch (38) from the extended position to the retracted position and an unlocking position allowing pivotal movement of the latch (38) from the extended position to the retracted position. When the door is closed, the locking member (36) is moved by gravitational force to a locking position. Movement of the linking rod (37) in an unlatching position through an idle travel moves the locking member (36) from the locking position to the unlocking position without moving the latch (38). Further movement of the linking rod (37) in the unlatching position causes pivotal movement of the latch (38) from the extended position to the retracted position.

13 Claims, 17 Drawing Sheets

LATCH DEVICE FOR PANIC DOOR LOCK WITH ANTI-PICKING FUNCTION

BACKGROUND OF THE INVENTION

The present invention relates to a latch device for a panic door lock and, more particularly, to a latch device for a panic door lock that provides a reliable anti-picking function.

A typical lock for a panic door generally includes a press bar that can be pressed to retract a latch for unlatching the door in emergency conditions as well as for normal passage. The lock can be locked to prevent unauthorized access and can be unlocked by a key from an outer side of the door. However, a burglar can pick the latch in the latching position. In an approach to prevent picking, the lock further includes a safety member that is pressed against by the door frame to a position releasing a stop piece when the door is closed. The stop piece, when released, is biased by a spring to a position in a retraction path of the latch. Thus, the latch can not be picked, for retraction of the latch is hindered by the stop piece. An example of such a lock is disclosed in U.S. Pat. No. 7,070,210 to Lin. However, the anti-picking function is lost when the spring fatigues, but the door can still be opened and closed. As a result, the users still use the door without noticing the risk of burglary.

Thus, a need exists for a panic door lock that provides a reliable anti-picking function.

BRIEF SUMMARY OF THE INVENTION

The present invention solves this need and other problems in the field of panic door devices with anti-picking function by providing, in a preferred form, a latch device includes a bracket adapted to be fixed to a door. The bracket includes a first slot extending in a longitudinal direction. A latch is pivotably mounted to the bracket by a latch pin and pivotable between an extended, locking position and a retracted, unlocking position about a first pivot axis defined by the latch pin. A follower includes a first end pivotably connected to the latch by a pivot, a second end, and an extension intermediate the first and second ends of the follower. A linking rod extends in the longitudinal direction and movable in an unlatching direction for moving the latch from the extended, locking position to the retracted, unlocking position and a latching direction opposite to the unlatching direction for moving the latch from the retracted, unlocking position to the extended, locking position. The linking rod includes an end having a second slot extending in the longitudinal direction and aligned with the first slot. A limiting pin slideably extends through the first slot of the bracket and the second slot of the linking rod. Furthermore, the limiting pin extends through the second end of the follower, allowing joint pivotal movement of the limiting pin and the second end of the follower about a second pivot axis defined by the pivot. The linking rod is movable through an idle travel in the longitudinal direction without moving the limiting pin, the follower, and the latch. A swaying plate includes first and second ends and a pivotal portion intermediate the first and second ends of the swaying plate. The latch pin extends through the pivotal portion, allowing the first end of the swaying plate to pivot between first and second positions about the first pivot axis defined by the latch pin. A limiting block is fixed to the second end of the swaying plate to move therewith. The limiting block is movable between a holding position corresponding to the first position of the first end of the swaying plate and a releasing position corresponding to the second position of the first end of the swaying plate. A locking member is coupled to and actuatable by the limiting block. The locking member includes a guide groove removably receiving the extension of the follower. The locking member is releasably coupled with the linking rod and movable between an unlocking position and a locking position. The locking member is held in the unlocking position by the limiting block in the holding position. The locking member is movable between the unlocking position and the locking position when the limiting block is in the releasing position. The guide groove of the locking member is aligned with the extension of the follower when the locking member is in the unlocking position, allowing pivotal movement of the latch and the follower about the first pivot axis defined by the latch pin to the retracted, unlatching position and allowing the extension of the follower to pivot into the first guide groove of the locking member. The guide groove of the locking member is misaligned with the extension of the follower and does not allow pivotal movement of the latch and the follower about the first pivot axis defined by the latch pin to the retracted position of the latch when the locking member is in the locking position.

When the door is in an open position, the first end of the swaying plate is in the first position, and the latch is in the extended, locking position. Furthermore, the limiting block is in the holding position holding the locking member in the unlocking position. Movement of the linking rod in the unlatching position causes pivotal movement of the latch from the extended, locking position to the retracted, unlocking position.

When the door is in a closed position, the first end of the swaying plate is retained in the second position. Furthermore, the latch is in the extended, locking position. The limiting block is in the releasing position releasing the locking member to the locking position not allowing direct pivotal movement of the latch from the extended, locking position to the retracted, unlocking position. Movement of the linking rod in the unlatching position through the idle travel causes movement of the locking member from the locking position to the unlocking position. Further movement of the linking rod in the unlatching position causes pivotal movement of the latch from the extended, locking position to the retracted, unlocking position and causes movement of the extension of the follower into the first guide groove of the locking member.

In the most preferred form, the locking member moves from the unlocking position to the locking position by gravitational force when the limiting block is in the releasing position and the linking rod is disengaged from the locking member.

The present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
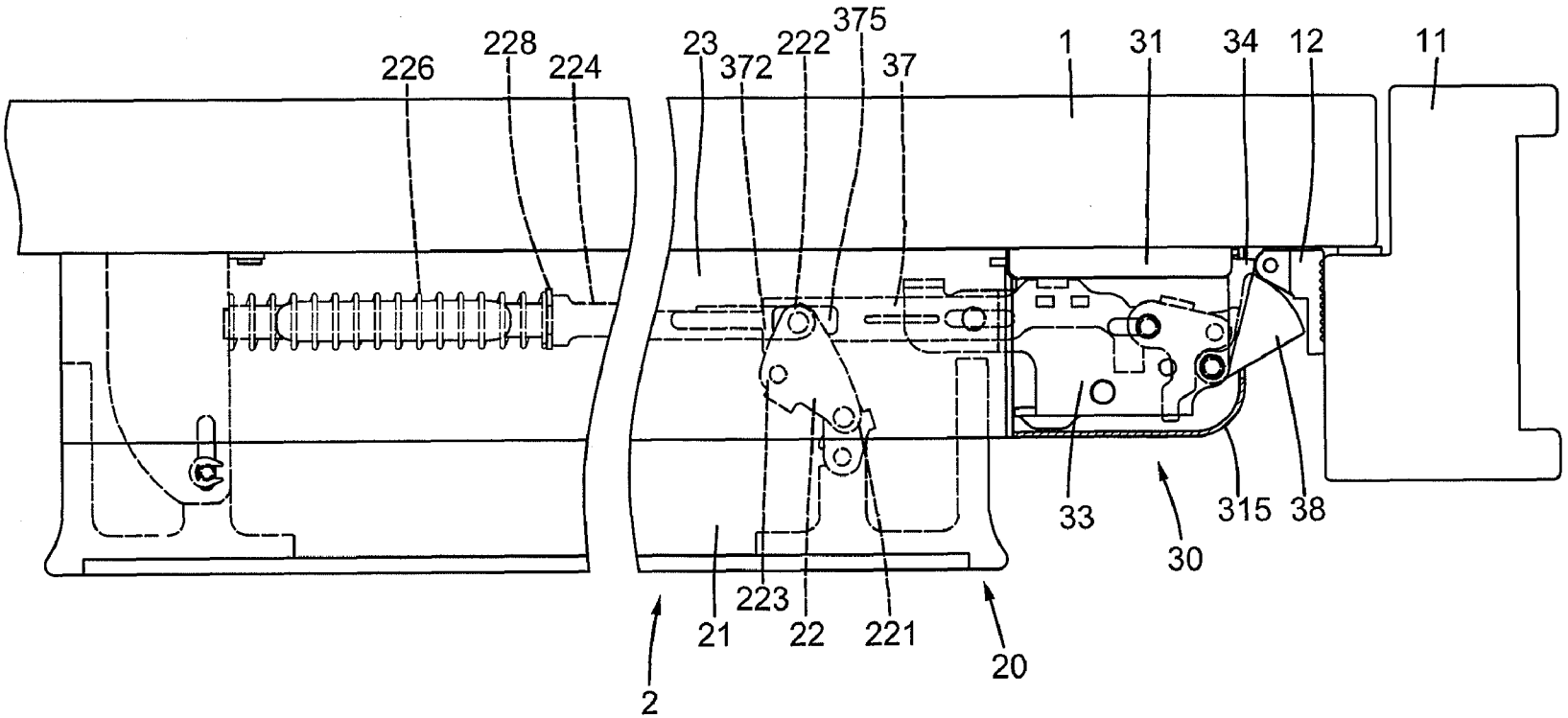
FIG. 1 shows a diagrammatic top view of a panic door lock with a latch device according to the preferred teachings of the present invention and a door to which the panic door lock is mounted, with the panic door lock in a locked position.
Figure 2:
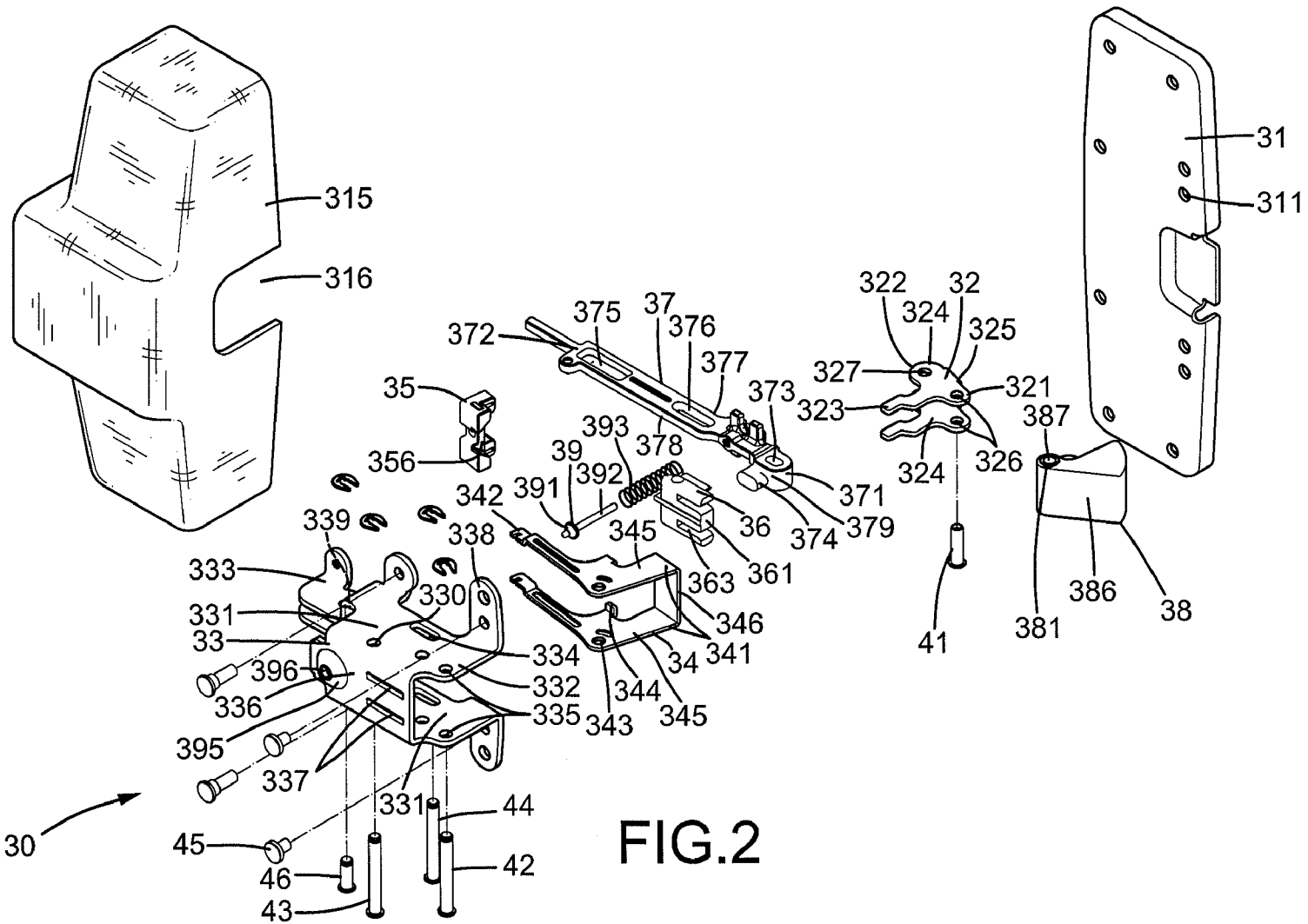
FIG. 2 shows an exploded, perspective view of the latch device of FIG. 1.

All figures are drawn for ease of explanation of the basic teachings of the present invention only; the extensions of the figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "upper", "lower", "front", "rear", "inner", "outer", "end", "portion", "section", "longitudinal", "lateral", "horizontal", "vertical", "inward", "leftward", "spacing", "length", "width", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

A latch device according to the preferred teachings of the present invention is shown in the drawings and generally designated 30. Latch device 30 is utilized with a lock 2 mounted to a panic door 1 pivotable relative to a door frame 11 having a stop 12 mounted thereto. According to the preferred form shown, latch device 30 has a base 31 fixed to an inner side of door 1 by fasteners such as screws, bolts, or the like. Base 31 includes a plurality of fixing holes 311. Latch device 30 further includes a bracket 33 in the most preferred form shown as a substantially U-shaped structure having parallel, spaced first and second sidewalls 331 spaced in a vertical direction. Bracket 33 further includes an interconnecting wall 336 interconnected between first and second sidewalls 331 and extending in the vertical direction. Each of first and second sidewalls 331 has a plurality of engaging portions 338. Fasteners 45 are extended through engaging portions 338 into fixing holes 311 to fix bracket 33 to base 31. Each of first and second sidewalls 331 further includes first and second sections 332 and 333 spaced in a longitudinal direction perpendicular to the vertical direction. Aligned pin holes 335 are defined in first sections 332, and aligned holes 339 are defined in second sections 333. First and second sidewalls 331 further include aligned holes 330 intermediate holes 339 and pin holes 335. Furthermore, first and second sidewalls 331 include aligned slots 334 intermediate holes 339 and pin holes 335. Each slot 334 extends in the longitudinal direction and is spaced from hole 330 in a direction perpendicular to the longitudinal direction. Interconnecting wall 336 includes upper and lower guide slots 337 extending in the longitudinal direction and spaced in the vertical direction. Interconnecting wall 336 further includes a bulged section 395 spaced from the upper and lower guide slots 337 in the longitudinal direction. Bulged section 395 defines a cavity 397 in an inner face of interconnecting wall 336 and has a hole 396 extending in a direction perpendicular to the vertical and longitudinal directions.

According to the preferred form shown, latching device 30 further includes a latch 38 having triangular cross sections. Specifically, latch 38 includes a first, inner face 382 having first and second ends, a second, arcuate face 385 having a first end interconnected to the first end of first face 382 and a second end, and a third, outer face 386 having first and second ends interconnected to the second ends of the first and second faces 382 and 385. A pivotal portion 381 is formed at a corner between the second end of first face 382 and the first end of third face 386 and includes a pin hole 387 extending in the vertical direction. A latch pin 42 is extended through pin holes 335 of bracket 33 and pin hole 387 to pivotably connect latch 38 to bracket 33, allowing latch 38 to pivot between an extended, locking position outside bracket 33 (FIG. 4) and a retracted, unlocking position inside bracket 33 (FIG. 7) about a pivot axis defined by latch pin 42 and extending in the vertical axis. According to the most preferred form shown, a cover 315 is mounted to base 31 to enclose latch device 30. Cover 315 includes an opening 316 through which latch 38 is movable. First face 382 includes a coupling block 383 formed thereon and having a pivot hole 384 adjacent pin hole 387.

According to the preferred form shown, a linking rod 37 is mounted between and spaced from first and second sidewalls 331 of bracket 33 in the vertical direction. Linking rod 37 extends in the longitudinal direction and has first and second ends 371 and 372 spaced in the longitudinal direction. Linking rod 37 further includes upper and lower faces 377 and 378 spaced in the vertical direction. First end 371 of linking rod 37 includes a slot 373 extending in the longitudinal direction and includes a front end **373*a* and a rear end 373*b* that is spaced from front end 373*a* in the longitudinal direction and that has a spacing to first end 371 of linking rod 37 larger than front end 337*a*. Slot 373 extends from upper face 377 through lower face 378 of linking rod 37 and is aligned with slots 334 of brackets 33. A limiting pin 44 is slideably extended through slots 334 of bracket 33 and slot 373 of linking rod 37. Linking rod 37 can move idly in the longitudinal direction without actuating limiting pin 44. The idle travel of linking rod 37 is equal to a length of slot 373 in the longitudinal direction. Specifically, when linking rod 37 is between first and second limit positions of its idle travel in the longitudinal direction relative to limiting pin 44, limiting pin 44 received in slot 337 is not moved. However, when movement of linking rod 37 exceeds the first or second limit position, the limiting pin 44 is moved in the longitudinal direction together with linking rod 37. First end 371 of linking rod 37 further includes a lateral face 379 extending between and perpendicular to upper and lower faces 377 and 378 of linking rod 37. A protrusion 374 protrudes from lateral face 379 in a direction perpendicular to the longitudinal direction and perpendicular to upper and lower faces 377 and 378. Second end 372 of linking rod 37 includes a slot 375. Linking rod 37 further includes a limiting slot 376 between slots 375 and 373 and extending in the longitudinal direction. A pin 46 is extended through holes 339 of bracket 33 and limiting slot 376 to assist in stable movement of linking rod 37 in the longitudinal direction between first and second sidewalls 331 of bracket 33**.

Figure 4:
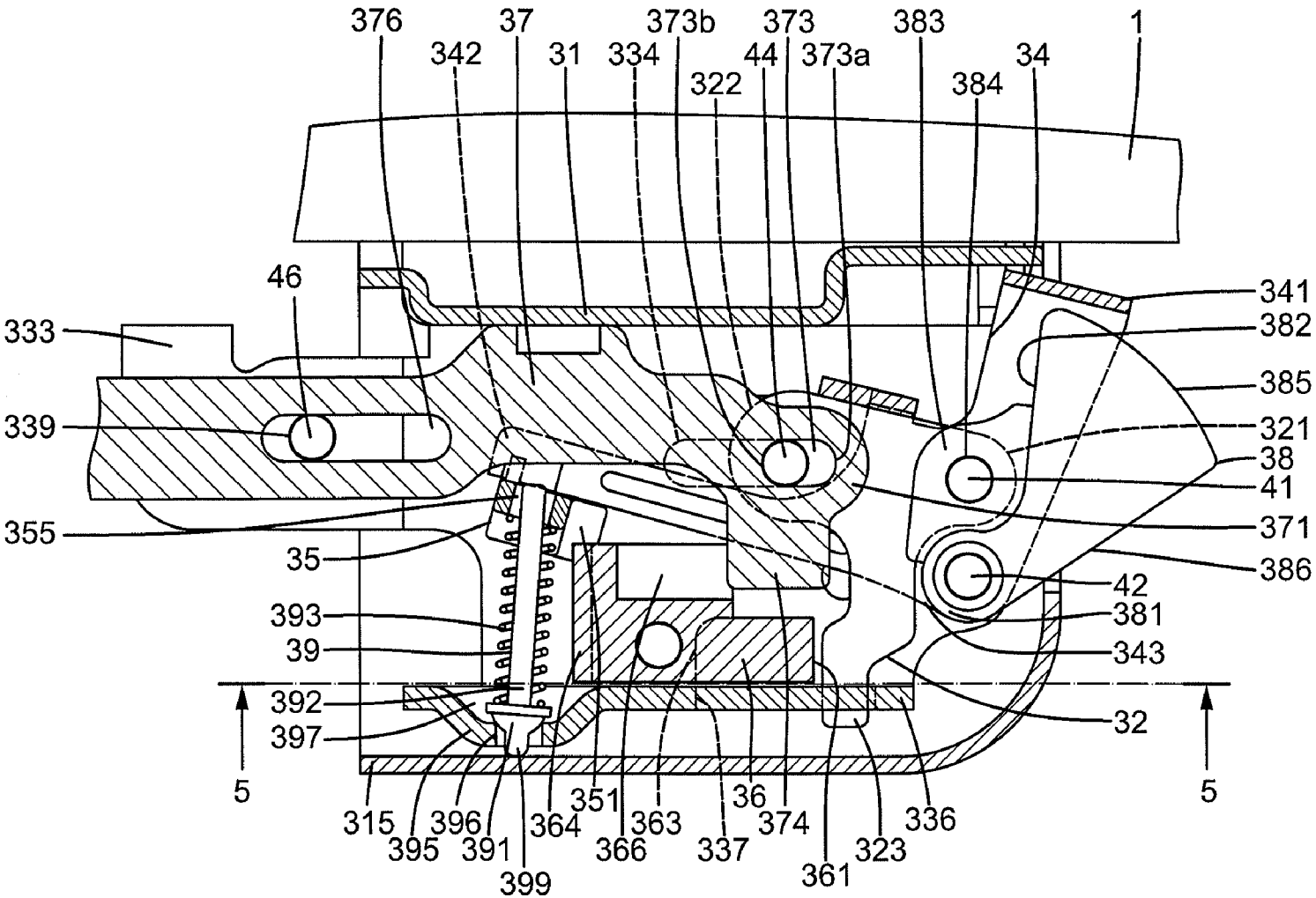
FIG. 4 shows a partial, enlarged, cross-sectional view of the door and the panic door lock of FIG. 1 with a linking rod of the panic door lock in a first limit position of an idle travel thereof.
Figure 6:
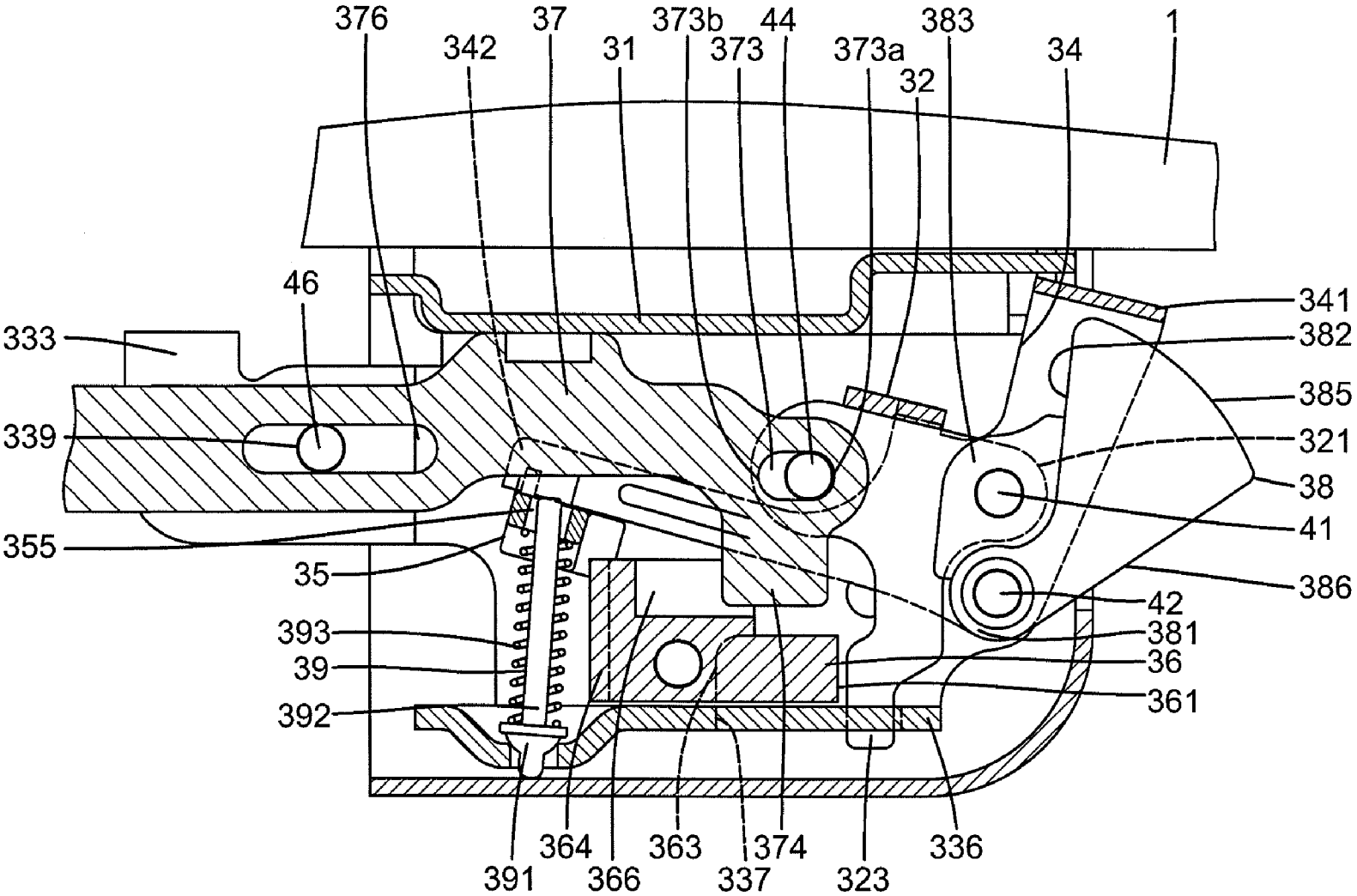
FIG. 6 shows a partial, enlarged, cross-sectional view of the door and the panic door lock of FIG. 1 with the linking rod of the panic door lock in a second limit position of the idle travel thereof.

According to the preferred form shown, a follower 32 is pivotably connected to coupling block 383 of latch 38. Follower 32 is substantially U-shaped in cross section and includes parallel first and second side plates 324 spaced in the vertical direction and an interconnecting plate 325 interconnected between first and second side plates 324. Each of first and second side plates 324 includes first and second ends 321 and 322 and an extension 323 extending from an intermediate portion thereof in a direction away from and perpendicular to interconnecting plate 325. First ends 321 of first and second side plates 324 include aligned pivot holes 326. A pivot 41 is extended through pivot hole 384 of coupling block 383 and pivot holes 326 of follower 32, allowing pivotal movement of follower 32 relative to latch 38 about a vertical pivot axis defined by pivot 41 and parallel to and spaced from the pivot axis of latch pin 42. Extensions 323 of follower 32 are slideably extended through guide slots 337 of bracket 33. Second ends 322 of first and second side plates 324 include aligned pin holes 327 through which limiting pin 44 extends. When linking rod 37 is in the first limit position of its idle travel, limiting pin 44 is in rear end 373*b* of slot 373 (FIG. 4). On the other hand, when linking rod 37 is in the second limit position of its idle travel, limiting pin 44 is in front end 373*a* of slot 373 (FIG. 6). Specifically, limiting pin 44 received in slot 373 is not moved when linking rod 37 is moved from the first limit position to the second limit position in an unlatching direction or from the second limit position to the first limit position in a latching direction opposite to the unlatching direction. However, when linking rod 37 in the second limit position (FIG. 6) is further moved leftward (as viewed from FIG. 6) in the unlatching direction away from latch 38, limiting pin 44 is moved leftward in the longitudinal direction and pivots latch 38 to the retracted, unlocking position.

Figure 7:
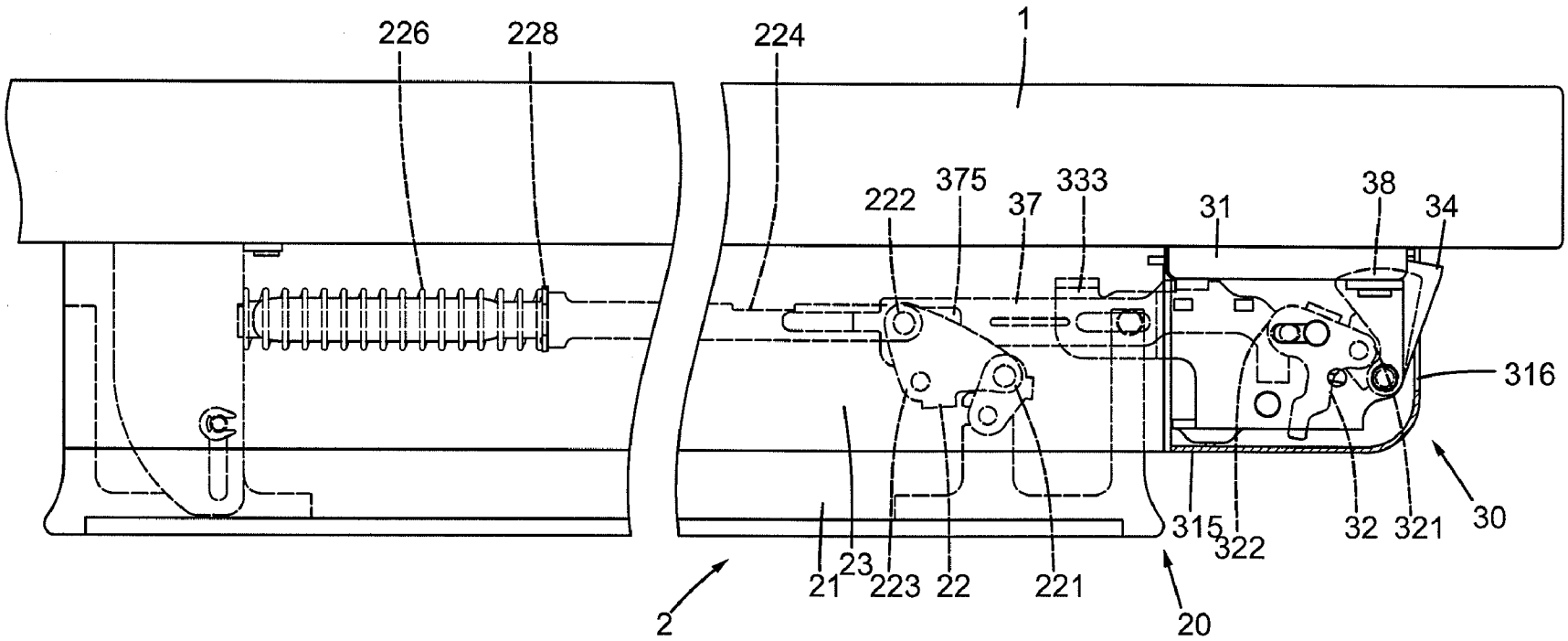
FIG. 7 shows a partial, top view of the door and the panic door lock of FIG. 1 with an operative member pressed to retract a latch.

According to the preferred form shown, lock 2 further includes an operative device 20 coupled with second end 372 of linking rod 37. Operative device 20 includes a housing 23 fixed to the inner side of door 1 and an operative member 21 in the most preferred form shown as a press bar pivotably coupled to housing 23. A rocker 22 is mounted in housing 23 and includes a first corner 221 pivotably connected to operative member 21, a second corner 222 pivotably coupled with slot 375 of second end 372 of linking rod 37, and a third corner 223 pivotably connected to housing 23. When operative member 21 is operated (e.g., pressed), rocker 22 pivots to move linking rod 37 in the unlatching direction to retract latch 38 to the retracted, unlocking position (FIG. 7). According to the most preferred form shown, a rod 224 has an end coupled to linking rod 37 to move therewith. Specifically, when operative member 21 is operated, rod 224 moves in the unlatching direction away from bracket 33 together with linking rod 37 and compresses a spring 226 mounted between a portion of housing 23 and a plate 228 fixed to rod 224. When operative member 21 is released, linking rod 37 and rod 224 moves in the latching direction and return to positions shown in FIG. 1 under the action of spring 226, and latch 38 moves to the extended, locking position outside bracket 33. Other arrangements for returning linking rod 37 and latch 38 would be within the skill of the art. Furthermore, operative device 20 for actuating linking rod 37 can be of any desired form as conventional including but not limited to of a commercially available type.

Figure 3:
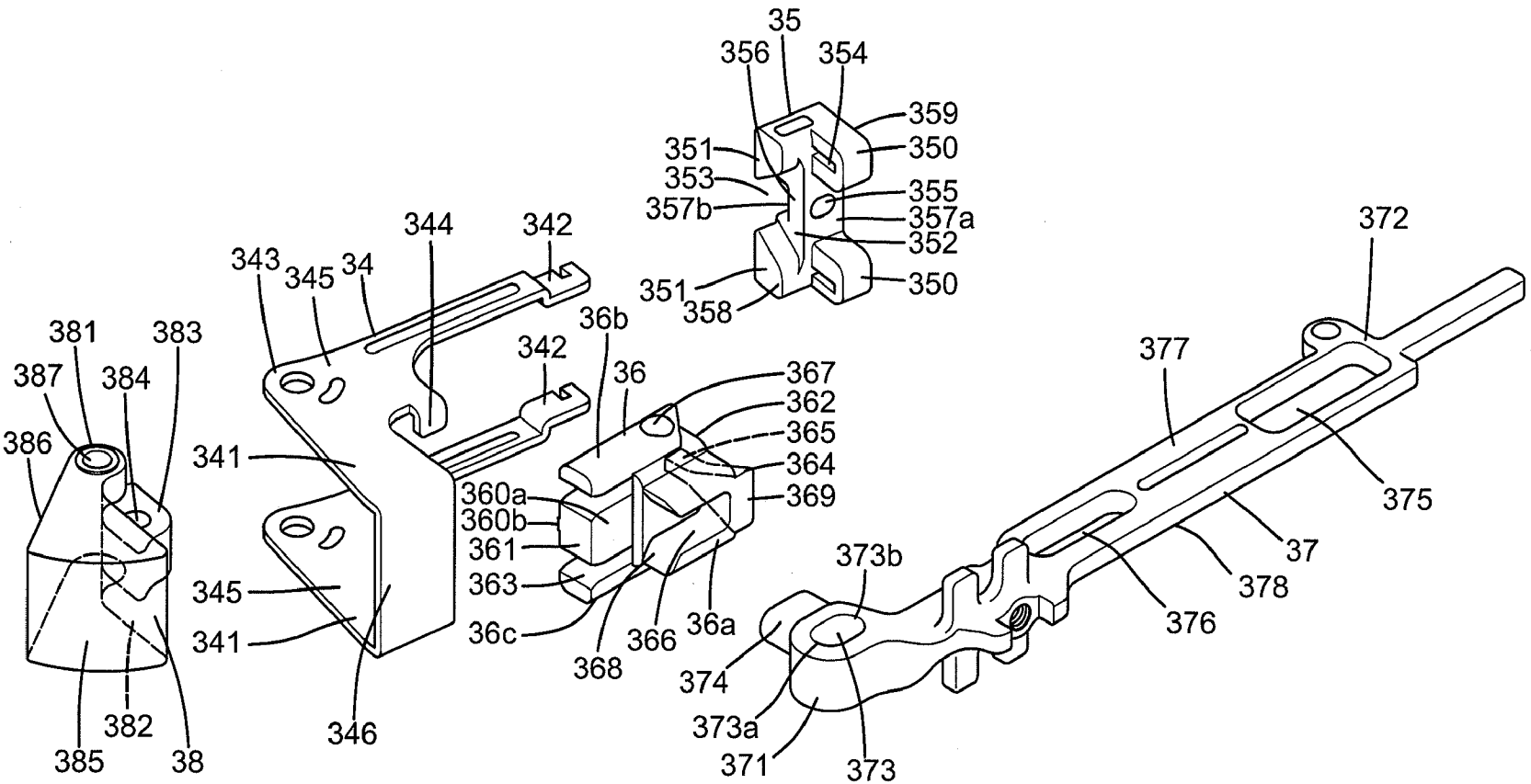
FIG. 3 shows an enlarged, exploded, perspective view of some components of the latch device of the panic door lock of FIG. 1.
Figure 8:
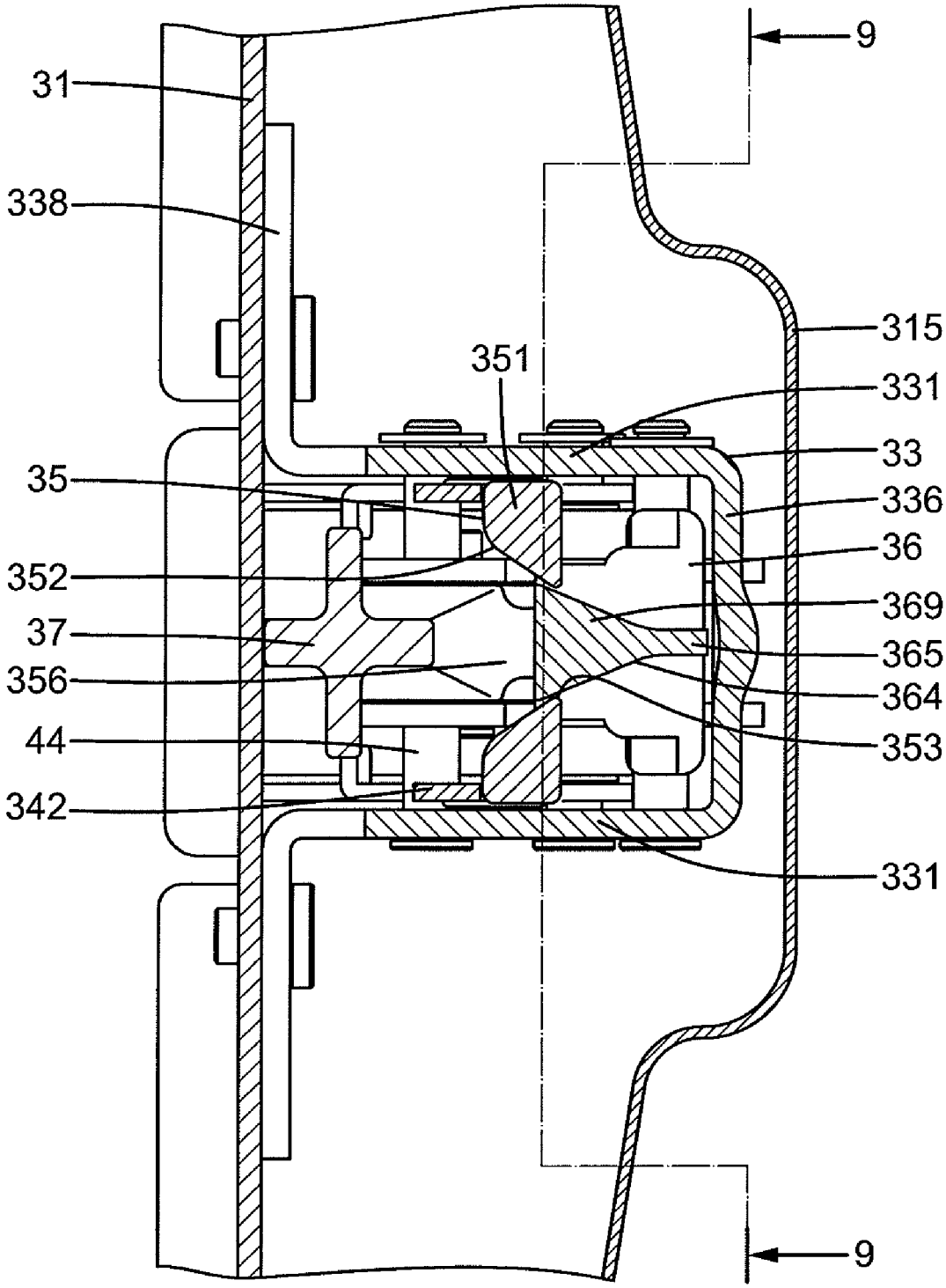
FIG. 8 shows a partial, cross-sectional view of the panic door lock of FIG. 1 according to section line 8-8 of FIG. 5.

According to the preferred form shown, a locking member 36 is mounted between first and second sidewalls 331 of bracket 33 and spaced from first end 371 of linking rod 37 in a direction perpendicular to the longitudinal and vertical directions. According to the most preferred form shown, locking member 36 is substantially E-shaped in cross section. Specifically, locking member 36 includes front and rear faces 361 and 362 spaced in the longitudinal direction. Locking member 36 further includes first and second lateral faces 360*a* and 360*b* extending between and perpendicular to front and rear faces 361 and 362. First lateral face 360*a* faces linking rod 37 and includes a lump 36*a* formed on a rear portion thereof distant to front face 361. Lump 36*a* has a groove 366 facing protrusion 374 of linking rod 37 and having an end opening 368. End opening 368 has a spacing to front face 361 larger than groove 366. Furthermore, end opening 368 has increasing widths in the vertical direction away from rear face 362 of locking member 36 (FIG. 3). Locking member 36 further includes top and bottom faces 36*b* and 36*c* extending between and perpendicular to front and rear faces 361 and 361 and extending between and perpendicular to first and second lateral faces 360*a* and 360*b*. A vertical hole 367 extends from top face 36*b* through bottom face 36*c* of locking member 36 (FIG. 3). A guide pin 43 is extended through pin holes 330 of bracket 33 and vertical hole 367 of locking member 36, allowing movement of locking member 36 between an upper, unlocking position and a lower, locking position spaced from the upper, unlocking position in the vertical direction. Two guide grooves 363 extend from front face 361 toward rear face 362 but spaced from rear face 362 in a horizontal direction perpendicular to the vertical direction. Guide grooves 363 are spaced in the vertical direction and spaced from top and bottom faces 36*b* and 36*c* of locking member 36. Furthermore, guide grooves 363 are spaced from groove 366 in a direction perpendicular to the vertical direction and to first lateral face 360*a*. A guide piece 364 in the most preferred form shown as a lug is formed on rear face 362 of locking member 36 and integrally formed with lump 36*a* as a single continuous monolithic member. Guide piece 364 includes a narrower section 365 and a wider section 369. Wider section 369 has a spacing to second lateral face 360*b* larger than narrower section 365 and a width in the vertical direction larger than that of narrower section 365 (FIG. 8). Wider section 369 includes triangular cross sections (when viewed from a vertical plane parallel to the vertical direction) and has decreasing widths in the vertical direction toward narrower section 365.

According to the most preferred form shown, a substantially U-shaped swaying plate 34 is pivotably mounted in bracket 33. Swaying plate 34 includes parallel first and second side boards 345 spaced in the vertical direction and received between sidewalls 331 of bracket 33. Swaying plate 34 further includes an interconnecting board 346 interconnected between first and second side boards 345. Each of first and second side boards 345 is substantially L-shaped and includes a first end 341 interconnected to interconnecting board 346, a second end 342, and a pivotal portion 343 on an intermediate portion intermediate the first and second ends 341 and 342. Second ends 342 of first and second side boards 345 are received between first and second sidewalls 331 of bracket 33. First ends 341 of first and second side boards 345 of swaying plate 34 are movable through opening 316 between a first, outer position outside of cover 315 and a second, inner position partially received in cover 315. Latch pin 42 is extended through aligned pin holes in pivotal portions 343 of swaying plate 34 to allow pivotal movement of swaying plate 34 about the pivot axis defined by latch pin 42. Second side board 345 includes a drive piece 344 formed on the intermediate portion thereof and adjacent to first end 341 thereof. Drive piece 344 extends in the vertical direction toward first side board 345.

According to the preferred form shown, a limiting block 35 is mounted to swaying plate 34 to move therewith. Limiting block 35 is movable between a holding position corresponding to the first, outer position of first ends 341 of first and second side boards 345 of swaying plate 34 and a releasing position corresponding to the second, inner position of first ends 341 of first and second side boards 345 of swaying plate 34. Limiting block 35 includes first and second lateral faces 357*a* and 357*b* spaced in a direction perpendicular to the vertical direction. Limiting block 35 further includes front and rear faces 358 and 359 extending between and perpendicular to first and second lateral faces 357*a* and 357*b* and perpendicular to the vertical direction. Upper and lower ears 350 are formed on upper and lower ends of first lateral face 357*a* and spaced in the vertical direction. Each of upper and lower ears 350 has an engaging groove 354 formed in a front face thereof. Second ends 342 of first and second side boards 345 of swaying plate 34 are coupled with engaging grooves 354 to allow joint pivotal movement of swaying plate 34 and limiting block 35. A through-hole 355 extends from first lateral face 357*a* through second lateral face 357*b* and is intermediate upper and lower ears 350. A guide groove 356 is formed in an intermediate portion of front face 358 of limiting block 35 and extending from first lateral face 357*a* through second lateral face 357*b*, leaving upper and lower protrusions 351 on upper and lower ends of front face 358. Guide groove 356 is substantially trapezoidal in cross section and includes a first, larger end 352 in first lateral face 357*a* and a second, smaller end 353 in second lateral face 357*b*. Second, smaller end 353 has a width in the vertical direction smaller than a width of the first, larger end 352 in the vertical direction. Specifically, guide groove 356 has decreasing widths from first, larger end 352 toward second, smaller end 353. Second, smaller end 353 of guide groove 356 has a minimum width in the vertical direction smaller than a maximum width of wider section 369 of guide piece 364 of locking member 36 in the vertical direction.

According to the preferred form shown, a guide rod 39 is mounted between limiting block 35 and interconnecting wall 336 of bracket 33. Specifically, guide rod 39 includes a head 391 and a shank 392 extending from a side of head 391 and having a an end slideably received in through-hole 355 of limiting block 35. The other side of head 391 is domed and includes a tip 399 extending through hole 396 of bulged section 395 to prevent head 391 from disengaging from interconnecting wall 336. An outer periphery of the domed side of the head 391 slideably abuts an inner periphery of hole 396 of bulged section 395 so that head 391 can swivel against the inner periphery of hole 396 when shank 392 moves together with limiting block 35. A spring 393 is mounted around shank 392 between the side of head 391 and second lateral face 357*b* of limiting block 35. Note that a portion of head 392 outside of hole 396 is received in cavity 397 to avoid interference in operation of guide rod 39 and other components.

Figure 5:
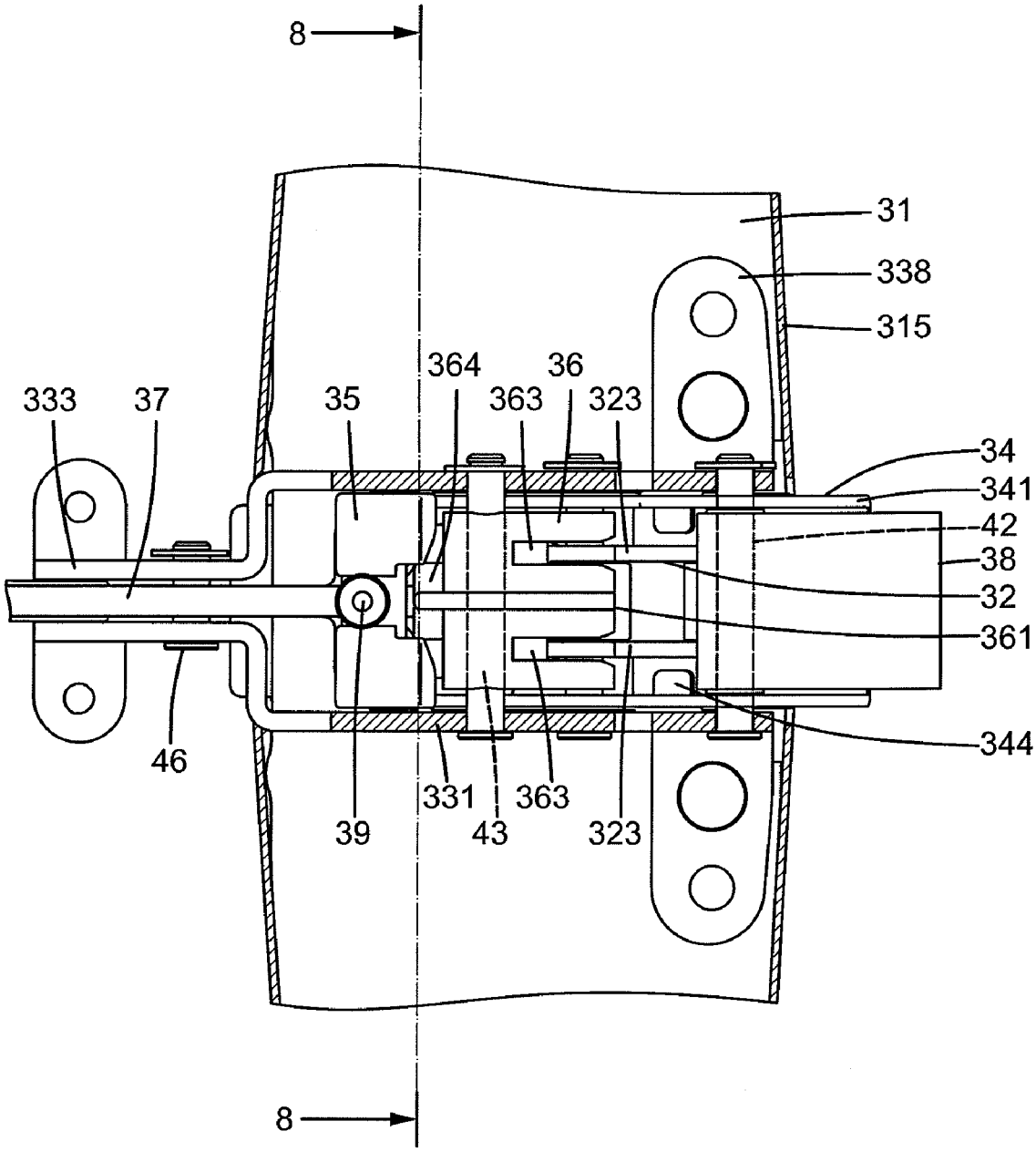
FIG. 5 shows a partial, cross-sectional view of the panic door lock of FIG. 1 according to section line 5-5 of FIG. 4.
Figure 9:
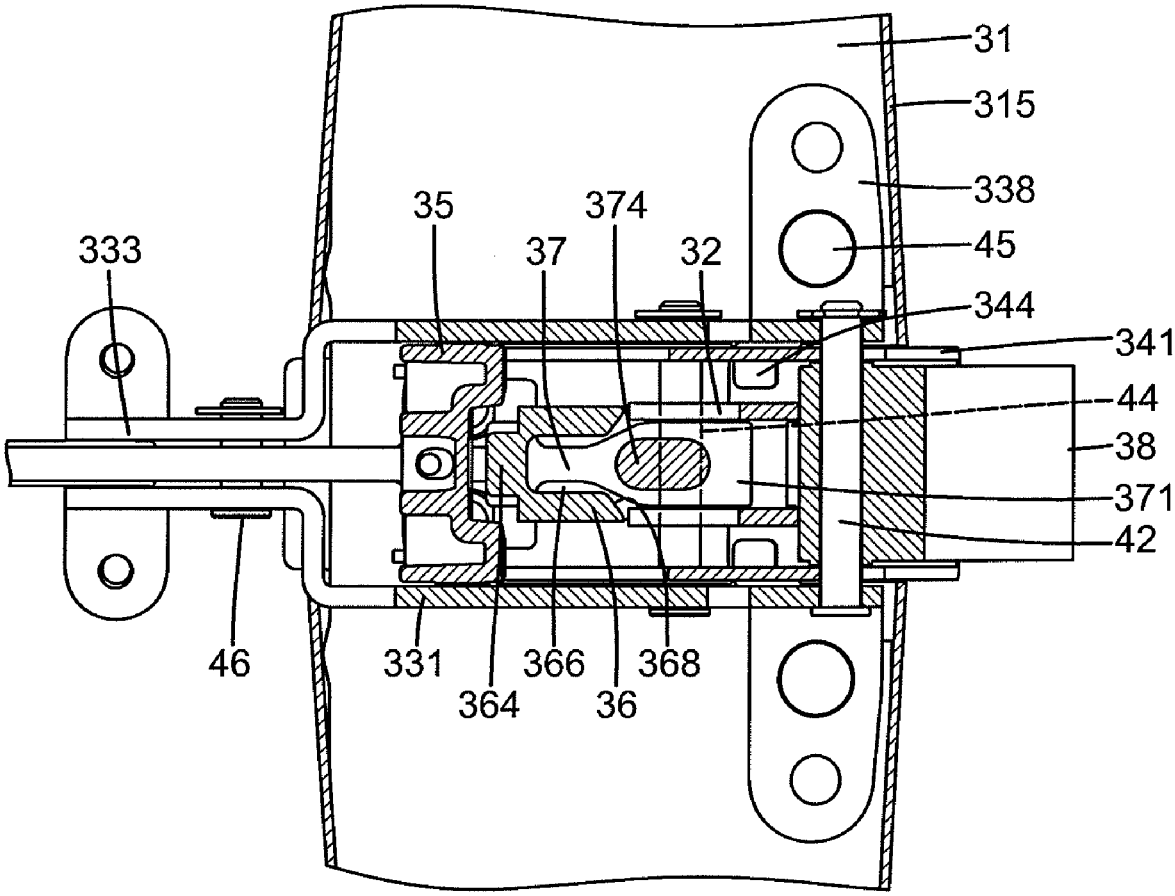
FIG. 9 shows a partial, cross-sectional view of the panic door lock of FIG. 1 according to section line 9-9 of FIG. 8.

Now that the basic construction of lock 2 of the preferred teachings of the present invention has been explained, the operation and some of the advantages of lock 2 can be set forth and appreciated. In particular, for the sake of explanation, it will be assumed that door 1 is not closed and latch 38 is in its extended, locking position shown in FIGS. 4, 5, 8, and 9. First ends 341 of first and second side boards 345 of swaying plate 34 are in the first, outer position outside of cover 315 under the action of spring 393 that presses against limiting block 35 fixed to swaying plate 34. In this case, limiting block 35 is in the holding position holding locking member 36 in its upper, unlocking position (FIG. 5), and wider section 369 of guide piece 364 of locking member 36 is received in second, smaller end 353 of guide groove 356 of limiting block 35 (FIG. 8). Furthermore, guide grooves 363 of locking member 36 are aligned with extensions 323 of follower 32. Further, linking rod 37 is in its first limit position. Specifically, protrusion 374 of linking rod 37 is aligned with but outside of groove 366 (FIG. 9), and limiting pin 44 is in rear end 373*b* of slot 373 (FIG. 4).

Figure 10:
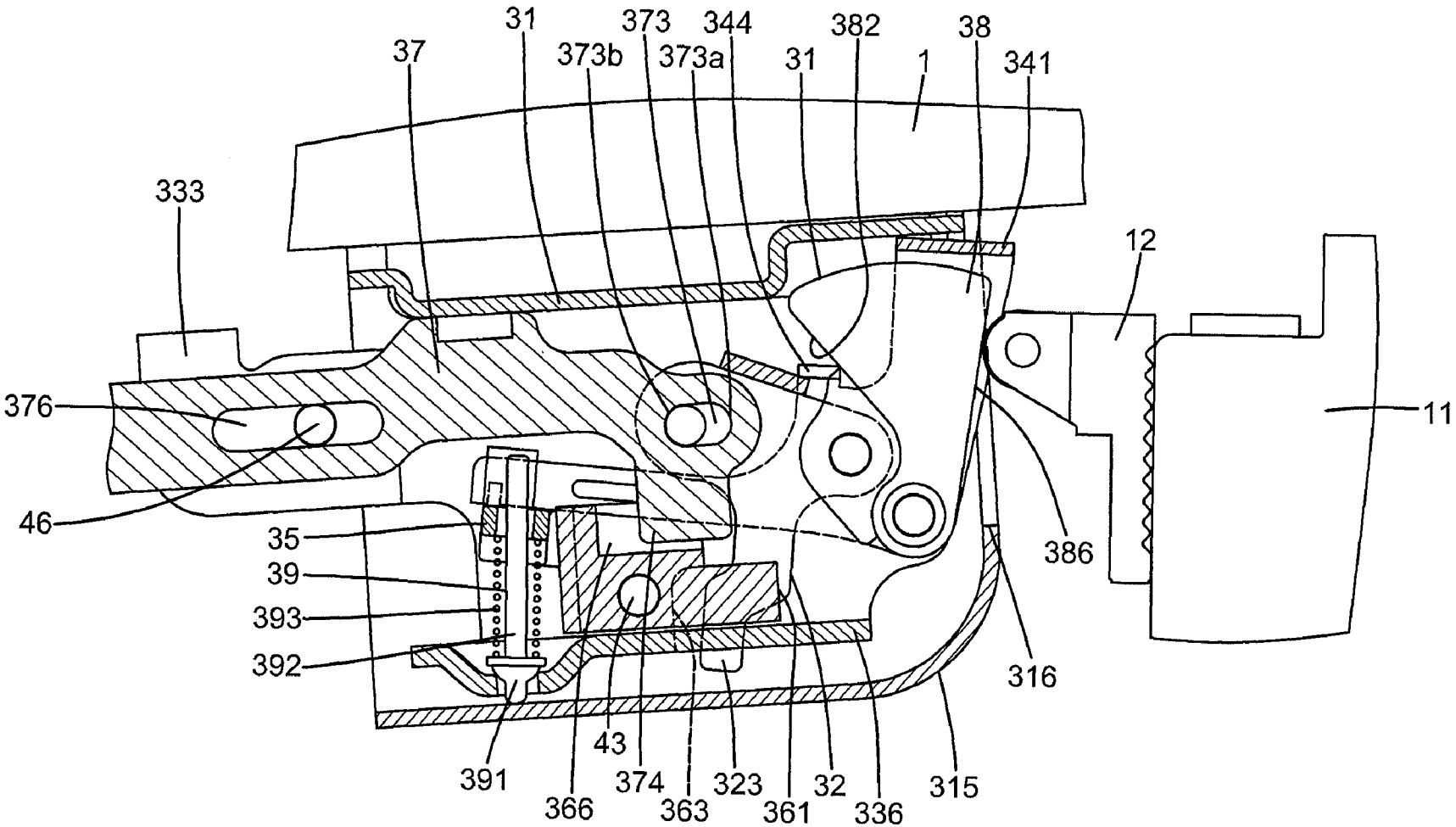
FIG. 10 shows a partial, enlarged, cross-sectional view of the door and the panic door lock of FIG. 1 with the door being closed.

When closing door 1, third face 386 of latch 38 is pressed against by stop 12 and, thus, pivots inward (FIG. 10). Follower 32 pivots inward together with latch 38 so that extensions 323 of follower 32 are extended through and engaged with guide grooves 363 of locking member 36. Pivotal movement of follower 32 also causes movement of limiting pin 44 in the unlatching direction away from latch 38, which, in turn, moves linking rod 37 in the unlatching direction away from latch 38 so that protrusion 374 of linking rod 37 is moved into and engaged with groove 366 of locking member 36. Furthermore, first face 382 of latch 38 presses against drive piece 344 of swaying plate 34 to make first ends 341 of first and second side boards 345 of swaying plate 34 pivot inward to the inner, second position, and limiting block 35 is moved to the releasing position. Specifically, guide groove 356 of limiting block 35 is moved to a position where second, smaller end 353 is aligned with and receives narrower section 365 of guide piece 364 of locking member 36. Namely, locking member 36 is no longer restrained by limiting block 35 but still held in the upper, unlocking position by protrusion 374. Note that first, larger end 352 of guide groove 356 provides a space allowing passage of wider section 369 of guide piece 364 of locking member 36.

Figure 11:
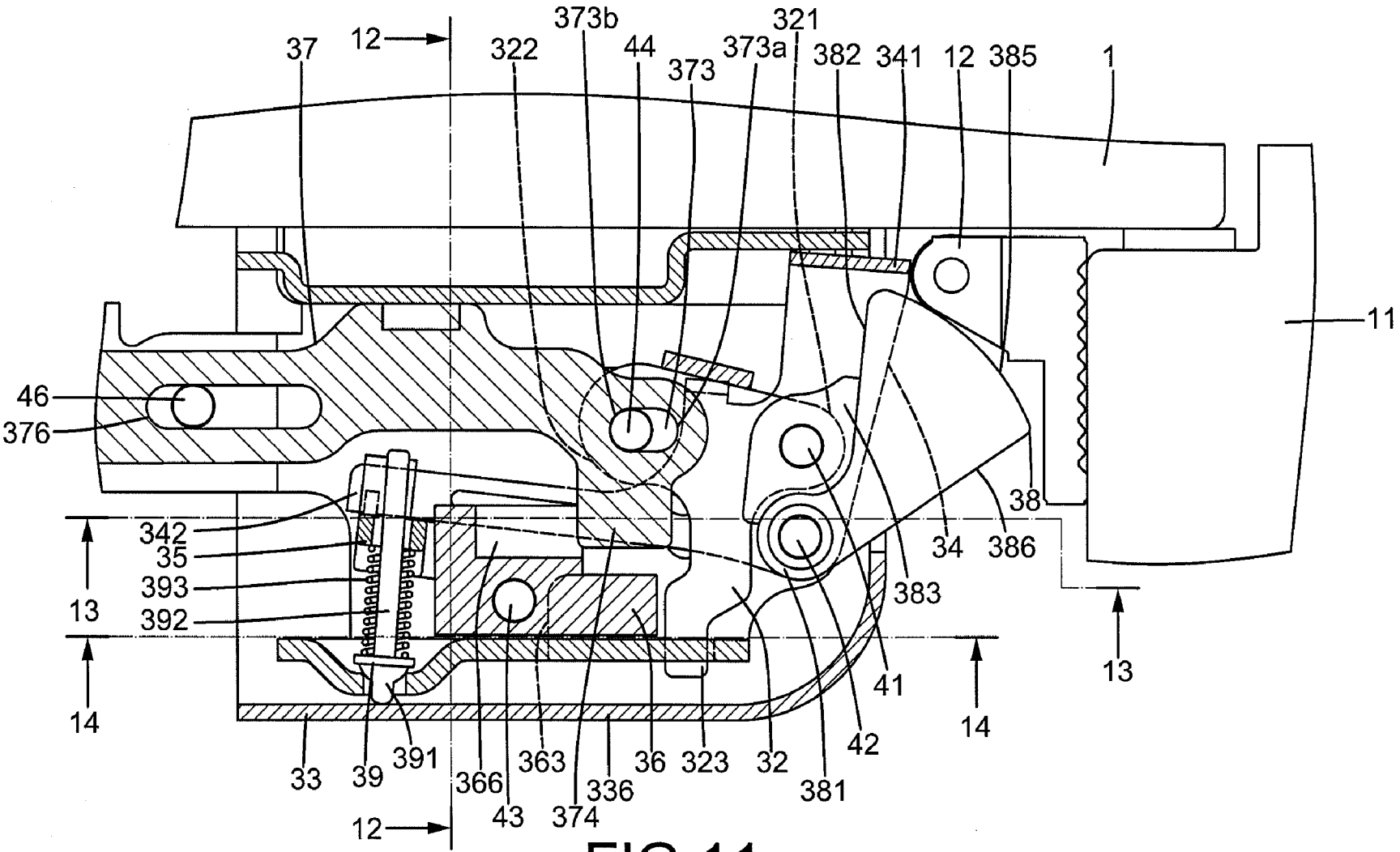
FIG. 11 shows a partial, enlarged, cross-sectional view of the door and the panic door lock of FIG. 1 with the door closed.
Figure 12:
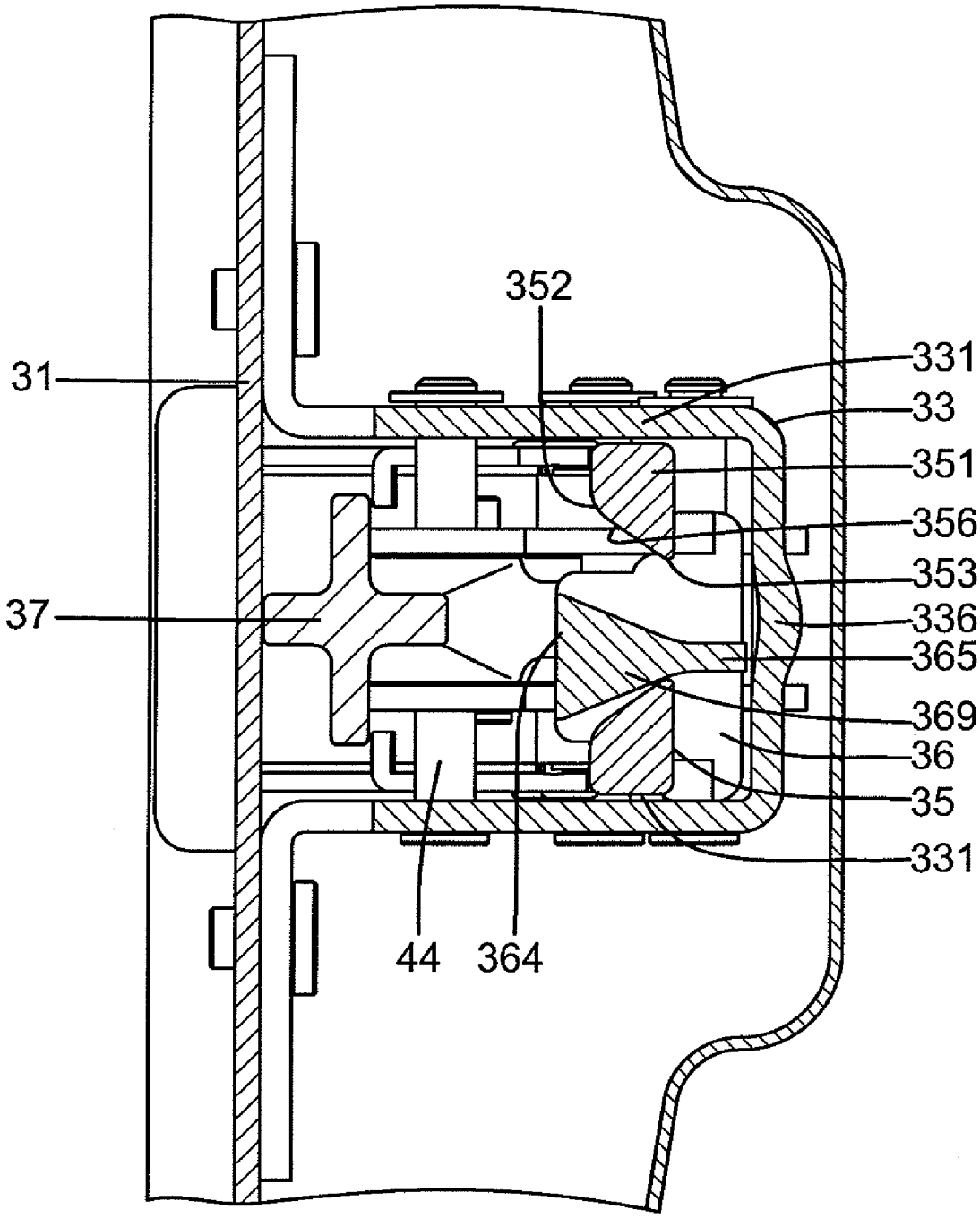
FIG. 12 shows a partial, cross-sectional view of the panic door lock of FIG. 1 according to section line 12-12 of FIG. 1.
Figure 13:
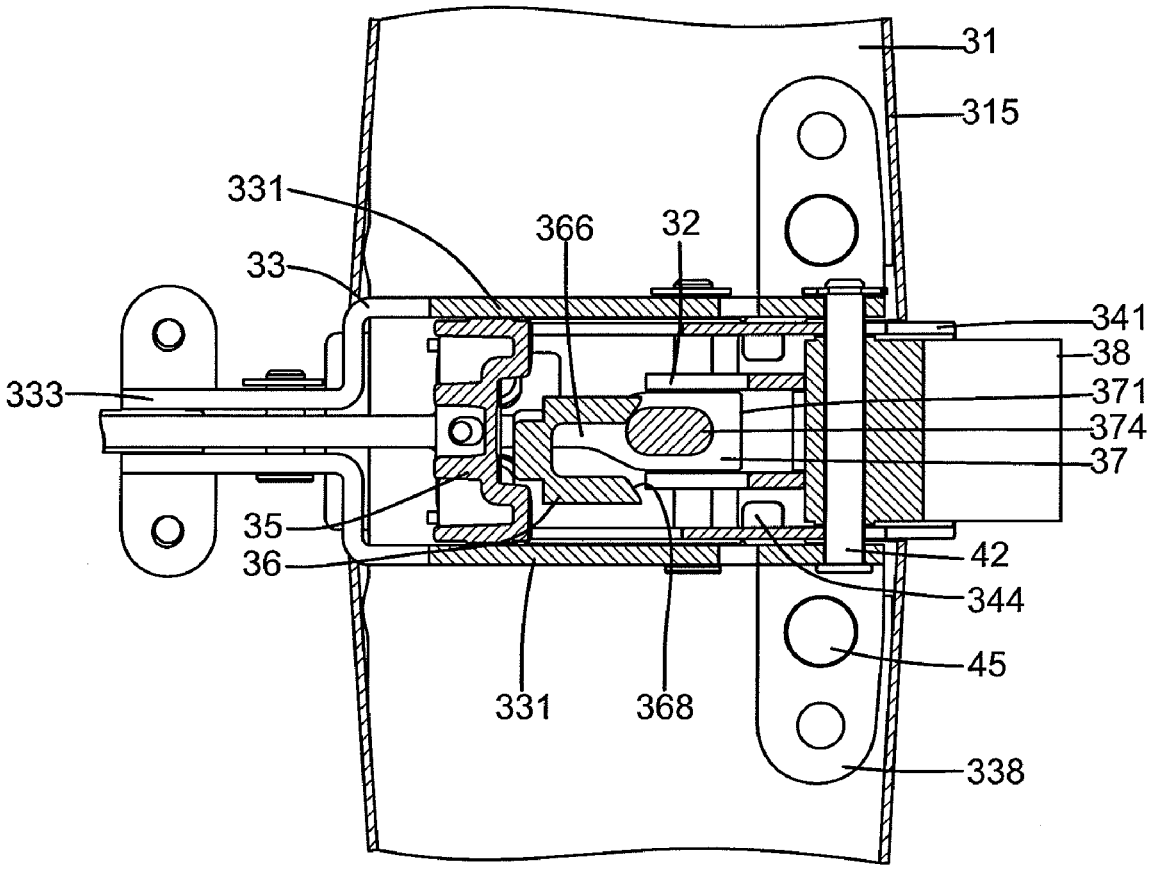
FIG. 13 shows a partial, cross-sectional view of the panic door lock of FIG. 1 according to section line 13-13 of FIG. 11.
Figure 14:
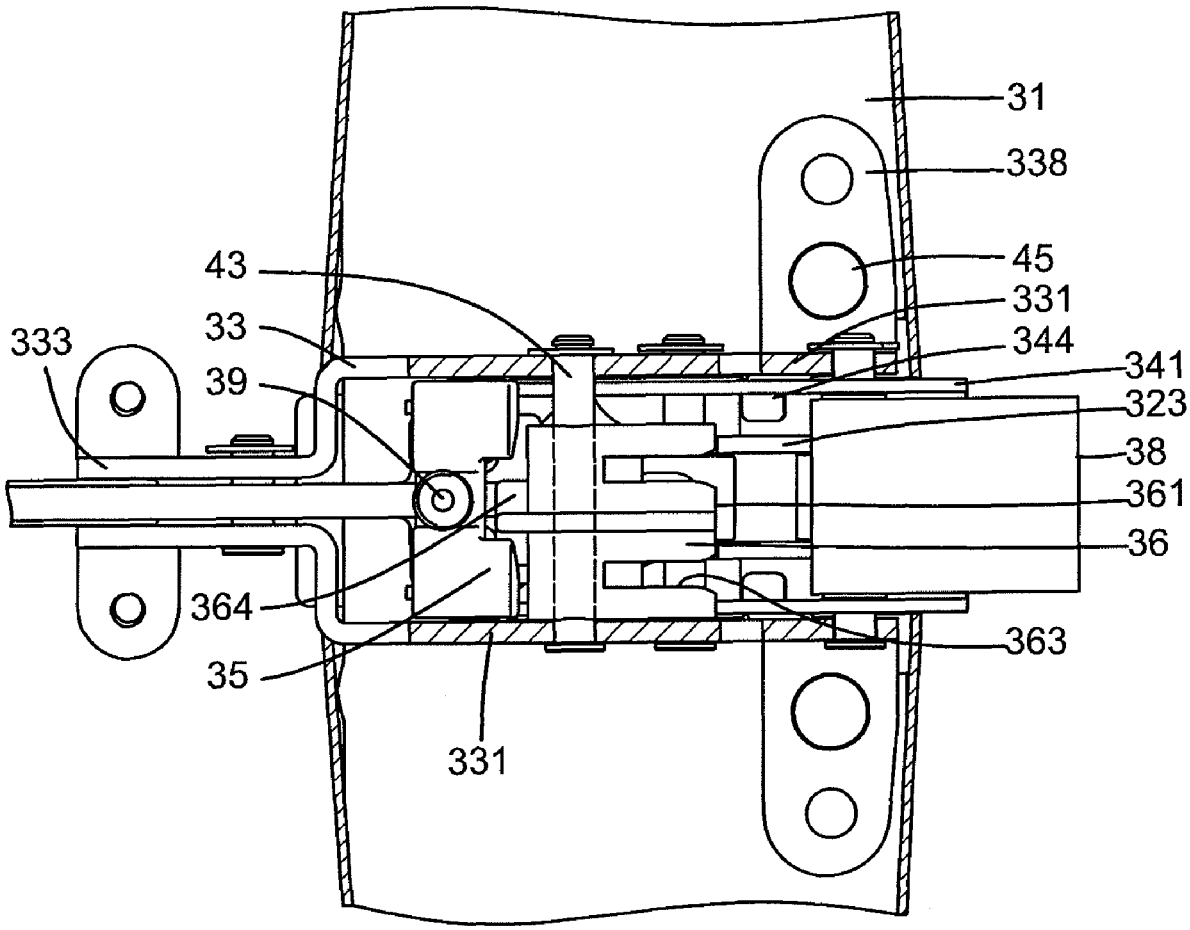
FIG. 14 shows a partial, cross-sectional view of the panic door lock of FIG. 1 according to section line 14-14 of FIG. 11.

When door 1 is completely closed, first ends 341 of first and second side boards 345 of swaying plate 1 are pressed against and retained in place by stop 12 in the inner, second position (FIG. 11). Limiting block 35 is retained in the releasing position. Note that locking member 36 is no longer restrained by limiting block 35, for the second, smaller end 353 of guide groove 356 is aligned with and receives narrower section 365 of guide piece 364 of locking member 36 (FIG. 12). At the same time, latch 38 returns to its extended, locking position under the action of spring 226, and second face 385 of latch 38 presses against stop 12 to lock door 1. Furthermore, linking rod 37 moves in the latching direction toward latch 38, such that protrusion 374 of linking rod 37 disengages from groove 366 of locking member 36. Thus, locking member 36 is released from protrusion 374 and moves downward along guide pin 43 under the action of gravitational force to the lower, locking position resting on an inner face of second sidewall 331 (FIG. 14). As a result, guide grooves 363 no longer align with extensions 323 of follower 32 (extensions 323 now abut front face 361 of locking member 36). Namely, when door 1 is completely closed, pivotal movement of latch 38 from the extended, locking position to the retracted, unlocking position is prevented, for the follower 32 that pivots together with latch 38 can not pivot inward due to the fact that extensions 323 of follower 32 are not aligned with and, thus, can not pivot into guide grooves 363 of locking member 36. An anti-picking function is, thus, provided. In this case, protrusion 374 of linking rod 37 is not aligned with and outside of groove 366 of locking member 36. Furthermore, protrusion 374 of linking rod 37 abuts against a wall portion of end opening 368 (FIG. 13).

Figure 15:
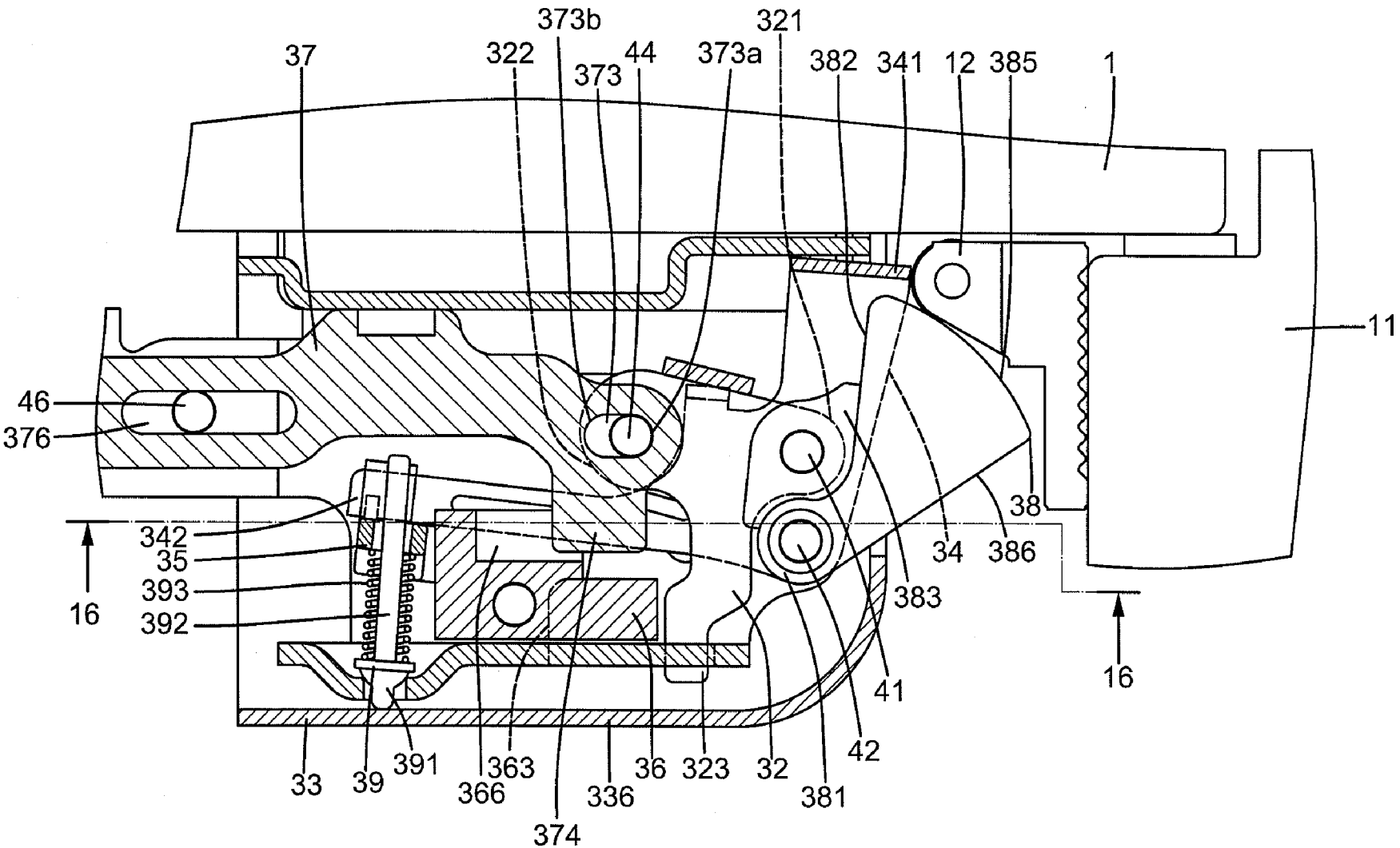
FIG. 15 shows a partial, cross-sectional view similar to FIG. 11 with the door is being opened and with the linking rod moved through the idle travel.
Figure 16:
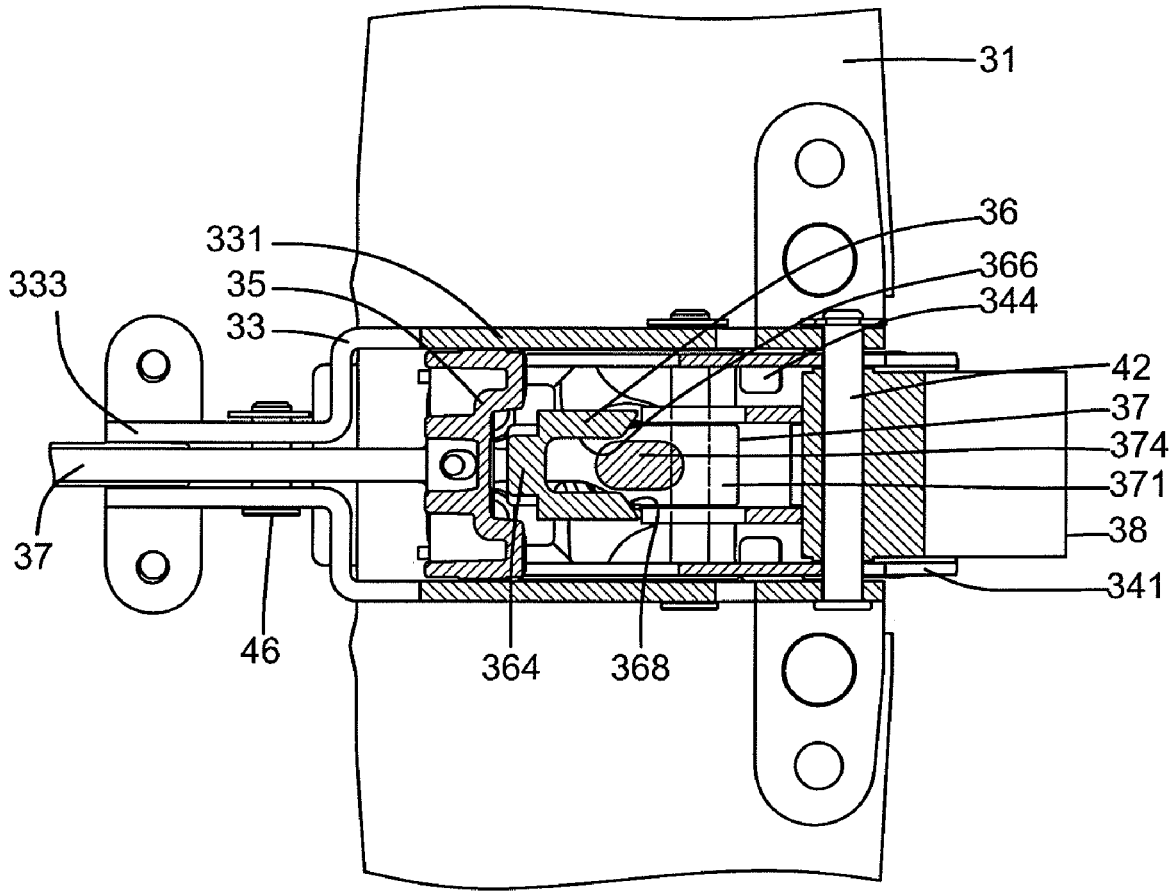
FIG. 16 shows a partial, cross-sectional view of the panic door lock of FIG. 1 according to section line 16-16 of FIG. 15.
Figure 17:
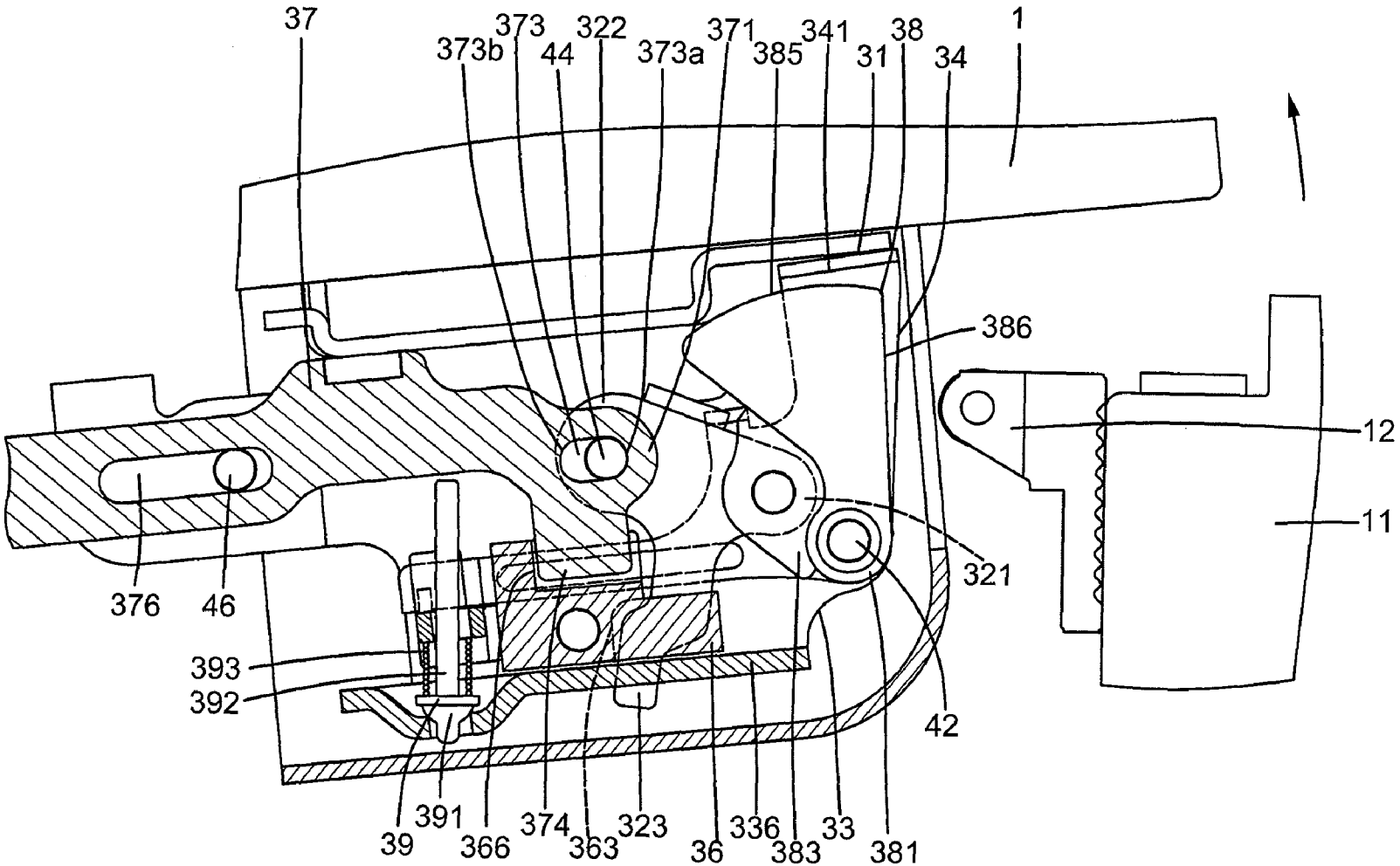
FIG. 17 shows a partial, enlarged, side view of the door and the panic door lock of FIG. 1 with the door opened.

When opening of door 1 is desired, operative member 21 is pressed to an extent to move linking rod 27 in the unlocking direction through pivotal movement of rocker 22. Specifically, linking rod 27 moves through its idle travel equal to the length of slot 373 without moving limiting pin 44 and follower 32 (FIG. 15). During the idle travel of linking rod 27, protrusion 374 of linking rod 37 moves through end opening 368 into groove 366 of locking member 36 and moves locking member 36 upward along guide pin 43 to the upper, unlocking position so that guide grooves 363 of locking member 36 are aligned with extensions 323 of follower 32 (see FIG. 5). Note that limiting pin 44 is now in front end 373*a* of slot 37. When operative member 21 is further pressed, linking rod 37 moves further in the unlocking direction to move limiting pin 44 in the unlocking direction. As a result, latch 38 pivots together with follower 32 to the retracted, unlocking position allowing opening of door 1 (FIG. 17).

Now that the basic teachings of the present invention have been explained, many extensions and variations will be obvious to one having ordinary skill in the art. For example, swaying plate 34 and follower 32 can be a single, flat piece. Specifically, interconnecting board 346 and one of first and second side boards 345 of swaying plate 34 can be omitted. Similarly, interconnecting plate 325 and one of first and second side plates 324 of follower 32 can be omitted. A key-operable lock device can be mounted to door 1 to allow access by a key. Such a key-operable lock device includes a member operably connected to linking rod 37, so that door 1 can be unlocked by the key that actuates the member to move linking rod 37 for unlatching latch 38.

Provision of spring 393 in cooperation with limiting block 35 and locking member 36 allows inward pivotal movement of latch 38 through pressing by stop 12 when door 1 is directly closed without the need of operation of operative member 21. However, the anti-picking function is not adversely affected when spring 393 malfunctions. Specifically, swaying plate 34 is still pressed inward when door 1 is closed even if spring 393 malfunctions. Limiting block 35 is moved to the releasing position releasing locking member 36 such that locking member 36 moves downward to the lower, locking position under the action of gravitational force. A reliable anti-picking function is, thus, provided. Furthermore, spring 393 can even be omitted without adversely affecting the anti-picking function. The problem of lost of anti-picking function resulting from malfunction of spring in the conventional locks is, thus, avoided.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A latch device for a door lock comprising:

a bracket (33) adapted to be fixed to a door, with the bracket (33) including a first slot (334) extending in a longitudinal direction;

a latch (38) pivotably mounted to the bracket (33) by a latch pin (42) and pivotable between an extended, locking position and a retracted, unlocking position about a first pivot axis defined by the latch pin (42);

a follower (32) including a first end (321) pivotably connected to the latch (38) by a pivot (41), a second end (322), and an extension (323) intermediate the first and second ends (321, 322) of the follower (32);

a linking rod (37) movably extending in the longitudinal direction, with the linking rod (37) movable in an unlatching direction for moving the latch (38) from the extended, locking position to the retracted, unlocking position and a latching direction opposite to the unlatching direction for moving the latch (38) from the retracted, unlocking position to the extended, locking position, with the linking rod (37) including an end (371) having a second slot (373) extending in the longitudinal direction and aligned with the first slot (334);

a limiting pin (44) slideably extending through the first slot (334) of the bracket (33) and the second slot (373) of the linking rod (37), with the limiting pin (44) extending through the second end (322) of the follower (32), allowing joint pivotal movement of the limiting pin (44) and the second end (322) of the follower (32) about a second pivot axis defined by the pivot (41), with the linking rod (37) being movable through an idle travel in the longitudinal direction without moving the limiting pin (44), the follower (32), and the latch (38);

a swaying plate (34) including first and second ends (341, 342) and a pivotal portion (343) intermediate the first and second ends (341, 342) of the swaying plate (34), with the latch pin (42) extending through the pivotal portion (343), allowing the first end (341) of the swaying plate (342) to pivot between first and second positions about the first pivot axis defined by the latch pin (42);

a limiting block (35) fixed to the second end (342) of the swaying plate (34) to move therewith, with the limiting block (35) movable between a holding position corresponding to the first position of the first end (341) of the swaying plate (34) and a releasing position corresponding to the second position of the first end (341) of the swaying plate (34);

a locking member (36) coupled to and actuatable by the limiting block (35), with the locking member (36) including a first guide groove (363) removably receiving the extension (323) of the follower (32), with the locking member (36) being releasably coupled with the linking rod (37) and movable between an unlocking position and a locking position, with the locking member (36) being held in the unlocking position by the limiting block (35) in the holding position, with the locking member (36) being movable between the unlocking position and the locking position when the limiting block (35) is in the releasing position, with the first guide groove (363) of the locking member (36) being aligned with the extension (323) of the follower (32) when the locking member (36) is in the unlocking position, allowing pivotal movement of the latch (38) and the follower (32) about the first pivot axis defined by the latch pin (42) to the retracted, unlatching position and allowing the extension (323) of the follower (32) to pivot into the first guide groove (363) of the locking member (36), with the first guide groove (363) of the locking member (36) being misaligned with the extension (323) of the follower (32) and not allowing pivotal movement of the latch (38) and the follower (32) about the first pivot axis defined by the latch pin (42) to the retracted position of the latch (38) when the locking member (36) is in the locking position;

wherein when the door is in an open position, the first end (341) of the swaying plate (34) is in the first position, the latch (38) is in the extended, locking position, the limiting block (35) is in the holding position holding the locking member (36) in the unlocking position, and movement of the linking rod (37) in the unlatching position causes pivotal movement of the latch (38) from the extended, locking position to the retracted, unlocking position, wherein when the door is in a closed position, the first end (341) of the swaying plate (34) is retained in the second position, the latch (38) is in the extended, locking position, the limiting block (35) is in the releasing position releasing the locking member (36) to the locking position not allowing direct pivotal movement of the latch (38) from the extended, locking position to the retracted, unlocking position, movement of the linking rod (37) in the unlatching position through the idle travel causes movement of the locking member (36) from the locking position to the unlocking position, and further movement of the linking rod (37) in the unlatching position causes pivotal movement of the latch (38) from the extended, locking position to the retracted, unlocking position and causes movement of the extension (323) of the follower (32) into the first guide groove (363) of the locking member (36).

2. The latch device for a door lock as claimed in claim 1, with the locking member (36) including front and rear faces (361, 362) spaced in the longitudinal direction, with the first guide groove (363) extending from the first face (361) toward and spaced from the rear face (362), with the linking rod (37) including upper and lower faces (377, 378) spaced in a vertical direction perpendicular to the longitudinal direction, and with the second slot (373) extending from the upper face (377) through the lower face (378).

3. The latch device for a door lock as claimed in claim 2, with the linking rod (37) further including a lateral (379) extending between and perpendicular to the upper and lower faces (377, 378), with a protrusion (374) protruding from the lateral face (379) in a direction perpendicular to the longitudinal direction and to the upper and lower faces (377, 378), with the locking member (36) including a groove (366) facing the lateral face (379) of the linking rod (37), with the protrusion (374) being engaged with the groove (366) when the locking member (36) is in the unlocking position, allowing joint movement of the linking rod (37) and the locking member (36), and with the protrusion (374) being disengaged from the groove (366) when the locking member (36) is in the locking position, not allowing joint movement of the linking rod (37) and the locking member (36).

4. The latch device for a door lock as claimed in claim 3, with the bracket (33) being U-shaped and including first and second sidewalls (331) spaced in the vertical direction and an interconnecting wall (336) interconnected between the first and second sidewalls (331), with the first and second sidewalls (331) including aligned pin holes (330), with the locking member (36) further including top and bottom faces (36*b*, 36*c*) spaced in the vertical direction, with a vertical hole (367) extending from the top face (36*b*) through the bottom face (36*c*), with the latch device (30) further comprising, in combination: a guide pin (43) extending through the pin holes (330) of the bracket (33) and the vertical hole (367), with the locking member (36) moving from the unlocking position to the locking position by gravitational force when the limiting block (35) is in the releasing position and the protrusion (374) of the linking rod (37) is disengaged from the groove (366).

5. The latch device for a door lock as claimed in claim 4, with the locking member (36) further includes first and second lateral faces (360*a*, 360*b*) extending between the front and rear faces (361, 362) and between the top and bottom faces (36*b*, 36*c*), with the first lateral face (360*a*) facing the protrusion (374) of the linking rod (37) and including a lump (36*a*) formed thereon, with the lump (36*a*) including the groove (366) releasably receiving the protrusion (374), and with the guide groove (363) spaced from the groove (366) in a direction perpendicular to the vertical direction and to the first lateral face (360*a*).

6. The latch device for a door lock as claimed in claim 5, with the locking member (36) further including a guide piece (364) formed on the rear face (362) thereof, with the guide piece (364) including a narrower section (365) and a wider section (369) having a spacing to the second lateral face (360*b*) larger than the narrower section (365), with the wider section (369) having a width in the vertical direction larger than that of the narrower section (365), with the limiting block (35) including first and second lateral faces (357*a*, 357*b*) spaced in a direction perpendicular to the vertical direction, with the limiting block (35) further including front and rear faces (358, 359) extending between the first and second lateral faces (357*a*, 357*b*), with the front face (358) of the limiting block (35) including a second guide groove (356) extending from the first lateral face (357*a*) through the second lateral face (357*b*) of the limiting block (35), with the second guide groove (356) including a first, larger end (352) in the first lateral face (357*a*) and a second, smaller end (353) in the second lateral face (357*b*), with the second guide groove (356) having decreasing widths in the vertical direction from the first, larger end (352) toward the second, smaller end (353), with the second, smaller end (353) having a minimum width in the vertical direction smaller than a maximum width of the wider section (369) of the guide piece (364) of the locking member (36) in the vertical direction, with the wider section (369) of the guide piece (364) of the locking member (36) being received in the second, smaller end (353) of the limiting block (35) when the limiting block (35) is in the holding position, and with the narrower section (365) the guide piece (364) the locking member (36) being received in the second, smaller end (353) of the limiting block (35) when the limiting block (35) is in the releasing position and the locking member (36) is in the locking position.

7. The latch device for a door lock as claimed in claim 6, with the latch device (30) further comprising, in combination: a spring (393) mounted between the limiting block (35) and the interconnecting wall (336) of the bracket (33) to bias the first end (341) of the swaying plate (34) to the first position.

8. The latch device for a door lock as claimed in claim 7, with the limiting block (35) further including a through-hole (355) extending from the first lateral face (357*a*) through the second lateral face (357*b*), with the latch device (30) further comprising, in combination: a guide rod (39) mounted between the limiting block (35) and the interconnecting wall (336) of the bracket (33), with the spring (393) mounted around the guide rod (39), and with the guide rod (39) having an end slideably extending through the through-hole (355) of the limiting block (35).

9. The latch device for a door lock as claimed in claim 8, with the interconnecting wall (336) of the bracket (33) including a hole (396) perpendicular to the longitudinal and vertical directions, with the guide rod (39) including a head (391) and a shank (392) extending from a side of the head (391), with the shank (392) having the end slideably extending through the through-hole (355) of the limiting block (35), with the head (391) further including a tip (399) extending from another side thereof and received in the hole (396) of the interconnecting wall (336), with the other side of the head (391) being domed and slideably abutting an inner periphery of the hole (396) of the interconnecting wall (336), such that the head (391) swivels against the inner periphery of the hole (396) of the interconnecting wall (336) when the shank (392) moves together with the limiting block (35).

10. The latch device for a door lock as claimed in claim 5, with the groove (366) further including an end opening (368) having a spacing to the front face (361) larger than the groove (366), with the end opening (368) having increasing widths in the vertical direction away from the rear face (362) of the locking member (368), with the protrusion (374) of the linking rod (37) abutting against a wall portion of the end opening (368) when the door is completely closed.

11. The latch device for a door lock as claimed in claim 4, with the latch (38) including substantially triangular cross sections, with the latch (38) including a first face (382) having first and second ends, a second face (385) having a first end interconnected to the first end of the first face (382), and a third face (386) having first and second ends interconnected to the second ends of the first and second faces (382, 385), with a pivotal portion (381) being formed between the second end of the first face (382) and the first end of the third face (386) and including a pin hole (387) extending in the vertical direction, with the latch pin (42) extending through the pin hole (387) of the latch (38).

12. The latch device for a door lock as claimed in claim 11, with the latch (38) further including a coupling block (383) formed on the first face (382) and having a pivot hole (384) adjacent the pin hole (387) of the latch (38), with the pivot (41) extending through the first end (322) of the follower (32) and the pivot hole (384) of the mounting block (383), and with the first and second pivot axes being parallel to and spaced from each other and extending in the vertical direction.

13. The latch device for a door lock as claimed in claim 12, with the swaying plate (34) further including a drive piece (344) intermediate the first and second ends (341, 342) thereof, with the drive piece (344) facing the first face (382) of the latch (38), with the first face (382) of the latch (38) pressing against the drive piece (344) to pivot the first end (341) of the swaying plate (34) from the first position to the second position and to move the limiting block (35) to the releasing position when the latch (38) is moving form the extended, locking position to the retracted, unlocking position.

* * * * *